US008109457B2

(12) United States Patent
Latchireddi

(10) Patent No.: US 8,109,457 B2
(45) Date of Patent: Feb. 7, 2012

(54) MULTI-STAGE DISCHARGER FOR GRINDING MILLS

(75) Inventor: Sanjeeva Latchireddi, Jacksonville, FL (US)

(73) Assignee: Outotec Oyj, Espoo (FI)

( * ) Notice: Subject to any disclaimer, the term of this patent is extended or adjusted under 35 U.S.C. 154(b) by 152 days.

(21) Appl. No.: 12/699,769

(22) Filed: Feb. 3, 2010

(65) Prior Publication Data

US 2011/0186666 A1 Aug. 4, 2011

(51) Int. Cl.
*B07B 13/00* (2006.01)
*B07C 7/00* (2006.01)
*B02C 9/04* (2006.01)

(52) U.S. Cl. ..... 241/70; 241/71; 241/299

(58) Field of Classification Search ..... 241/70, 241/71, 299

See application file for complete search history.

(56) References Cited

U.S. PATENT DOCUMENTS

| | | | | |
|---|---|---|---|---|
| 3,739,993 | A * | 6/1973 | Nelson et al. | 241/70 |
| 3,804,346 | A | 4/1974 | Norman | |
| 4,185,785 | A * | 1/1980 | Nelson | 241/70 |
| 4,323,199 | A | 4/1982 | Jardine et al. | |
| 4,406,417 | A | 9/1983 | Jardine et al. | |
| 5,361,997 | A * | 11/1994 | Burkes | 241/70 |
| 7,566,017 | B2 | 7/2009 | Latchireddi | |

FOREIGN PATENT DOCUMENTS

WO 98/01226 1/1998

* cited by examiner

*Primary Examiner* — Bena Miller
(74) *Attorney, Agent, or Firm* — Chernoff, Vilhauer, McClung & Stenzel

(57) ABSTRACT

A pulp lifter assembly for a rotary grinding mill includes an outer pulp lifter having walls defining a pulp lifter chamber and an outlet opening for radially inward discharge of slurry from the pulp lifter chamber, and an inner discharger disposed radially inward of the outer pulp lifter and circumferentially offset from the outer pulp lifter. The inner discharger defines a passage for conveying slurry substantially radially inward. A transition discharger is disposed radially between the outer pulp lifter and the inner discharger. The transition discharger has a first wall bounding an interior space and a second wall dividing the interior space into first and second regions. The second wall includes a guide that bounds a channel connecting the outlet opening of the outer pulp lifter to the passage defined by the inner discharger.

4 Claims, 10 Drawing Sheets

A-A
PRIOR ART

MULTI-STAGE DISCHARGER FOR GRINDING MILLS

BACKGROUND OF THE INVENTION

The subject matter of this application relates to apparatus for discharging material from a rotary mill that is used for grinding or comminution.

FIGS. 1 and 2 show a rotary grinding mill 1 that contains material 2 to be ground therein with the aid of grinding media. The mill 1 is arranged to rotate around a rotation axis 3. The mill has a feed trunnion 4 and a discharge trunnion 5 by which the mill is supported on bearings (not shown) to a mechanical ground. The material 2 to be ground in the mill is fed into a grinding chamber of the mill 1 through the feed trunnion 4. Water is advantageously also fed into the mill 1 in order to create a wet grinding in the mill 1. Between the grinding chamber and the discharge trunnion 5 of the mill 1, a framework 6 is installed inside the mill 1 and supported to the body 7 of the mill 1. The framework 6 supports a pulp lifter assembly that comprises guide members 8, 9 and a discharge cone 10. The pulp lifter assembly directs the ground material from the grinding chamber to the discharge trunnion 5 of the mill 1. As illustrated in FIG. 2, the pulp lifter assembly comprises several sequential pulp lifters 11. Each pulp lifter 11 is attached to a grate or screen 12 having holes 13 through which the ground material 2 passes and enters a slurry pocket of the pulp lifter. As illustrated in FIG. 1, at least one pulp lifter 11 is at least partly immersed into the material 2 at a time during the operation of the mill 1. The pulp lifter 11 has a substantially rectangular or trapezoidal external shape so that two external sides or edges 21 of the pulp lifter 11 are essentially parallel and two other external sides or edges 22 are convergent to each other. The pulp lifter 11 is installed in the mill 1 so that the longer external side of the two parallel sides 21 is radially outward of the shorter of the two parallel sides and is close to the body 7 of the mill 1.

FIGS. 3 to 5 illustrate two pulp lifters 11A, 11B partially connected to each other. Each pulp lifter 11 has a first section 15 and a second section 16 separated by a wall 23. The grate or screen 12 with screening holes 13 is installed in front of the first section 15 of the pulp lifter 11 in the proceeding direction 19 of the material. Between the first section 15 of the pulp lifter 11B and the second section 16 of the pulp lifter 11A there is an opening 17. The second section 16 of each pulp lifter 11 is provided with a guide member 18, which extends from a point in the vicinity of the radially outer end of the leading edge 22 of the pulp lifter (with respect to the direction of rotation 24 of the mill) to a point in the vicinity of the radially inner end of the trailing edge 22 of the pulp lifter. As shown in the drawings, the guide member is constructed so that at least the part starting from the inlet of the second section is curved over at least 25% of the total length of the guide member. The outer end of the guide member (or the leading end in the direction of rotation of the mill) is directed tangentially of the mill whereas the inner or trailing end is directed essentially towards the rotating axis 3 of the mill 1.

During the operation of the mill 1, the mill 1 is rotated around its rotation axis 3 and the pulp lifters 11 are one after another immersed into the ground or comminuted material 2. While a given pulp lifter (such as the pulp lifter 11A) is immersed, some of the material 2 flows through the sieve or screen 12 into the first section 15 of the pulp lifter 11A. As the mill 1 continues to rotate, the first section 15 is step by step lifted from its immersed state, and the material in the first section 15 of the pulp lifter 11A flows downward into the second section 16 of the pulp lifter 11B through the opening 17. Owing to the guide member 18 in the second section 16 of the pulp lifter 11B the material flow is directed towards the center of the mill 1 and further by means of the guide members 8, 9 and 10 into the discharge trunnion 5 of the mill 1 and to the further processing of the material 2.

As the pulp lifter 11A rises, material that is in the radially outer region of the first section 15 flows downwards (see the arrow 19 in FIG. 4) into the second section 16 of the pulp lifter 11B through the opening 17 and is directed towards the central axis of the mill by the guide member. As the pulp lifters continue to rise, the material in the section 16 of the pulp lifter 11B is further directed towards the central axis and is discharged from the pulp lifter onto the guide members 8 and 9, which direct the material onto the cone 10. The material is unable to accumulate or collect in the outer lower corner region of the section 16.

The mill shown in FIGS. 1-5 rotates in the counter clockwise direction as seen in FIG. 2. Let us consider the situation where the pulp lifter 11A is at the 6 o'clock position (directly below the axis of rotation of the mill). In this case, several holes 13 in the grate 12 are immersed in the slurry and slurry enters the first section 15 of the pulp lifter 11A. Slurry also flows through the opening 17 into the second section 16 of the pulp lifter 11B, but cannot enter the lower rear (outer trailing) corner region of the second section because that region is blocked by the guide member 18. As the mill rotates from the 6 o'clock position towards the 3 o'clock position, the orientation of the pulp lifter 11A changes and some of the holes in the forward rows are exposed above the slurry while at least the radially outermost hole of the trailing row remains immersed. Since the slurry on the upstream side of the grate and the slurry in the first section 15 are in communication, pressure equilibrium between the upstream side of the grate and the first section is attained if the slurry in the first section of the pulp lifter flows downwards as the pulp lifter 11A rises, so that the free surface of the slurry in the pulp lifter tends to remain always lower than the free surface of the slurry on the upstream side of the grate keeping the flow gradient across the grate. In case the mill is fed more material 2 than the designed capacity of the pulp lifters, there is a possibility that some slurry will flow back out of the first section to the upstream side of the grate, but because the opening 17 is much larger than the holes 13 the major effect will be that the equilibrating flow will pass through the opening 17 into the second section 16 of the pulp lifter 11B. Further, because of the curved shape of the guide member, the lowest point in the available space in the second section 16 of the pulp lifter 11B, i.e. the space that is not blocked by the guide member 18, will move radially inwards, towards the central axis of the mill, as the mill rotates from the 6 o'clock position towards the 3 o'clock position instead of remaining in the lower outer corner of the second section. Depending on the depth of the slurry on the upstream side of the grate, some of the slurry in the second section may overflow the radially inner end of the guide member 18 and move towards the guide cone 10. In any event, when the pulp lifter 11A reaches the 3 o'clock position substantially all the slurry will have passed into the second section of the pulp lifter 11B and much of the slurry will have moved from the pulp lifter 11B towards the guide cone and as the pulp lifter reaches the 12 o'clock position, slurry will fall downward from the pulp lifter onto the guide cone 10.

FIG. 6 illustrates a practical implementation of the pulp lifter that is shown more schematically in FIGS. 3-5. Viewing the pulp lifter along the axis of rotation of the mill, the pulp lifter has a continuous back wall 24, an inner edge wall 25 formed with a discharge opening (not shown), and a leading edge wall 26. The pulp lifter is open at its front side. An intermediate wall 23 is spaced from the back wall 24 and is connected to the back wall by the guide 18. The guide 18 and the intermediate wall 23 separate the first section 15 of the pulp lifter from the second section 16. The leading edge wall 26 is formed with transfer openings 17. The grate (not shown) is attached to the pulp lifter using fasteners that engage holes 27 in the leading edge wall. When multiple pulp lifters are installed in a grinding mill, the first section 15 of the leading pulp lifter communicates with the second section 16 of the following pulp lifter through the transfer openings 17 in the leading edge wall 26 of the following pulp lifter. In operation, slurry enters the first section 15 of a pulp lifter through the holes in the grate as the lifter passes through the 6 o'clock position. As the pulp lifter rotates towards the 3 o'clock position, the pulp lifter rises relative to the following pulp lifter and slurry in the first section 15 of the leading pulp lifter flows through the transfer openings 17 into the second section 16 of the following pulp lifter. As the pulp lifters continue to rotate, the slurry in the second section of the following pulp lifter flows along the guide 18 and flows through the opening in the inner edge wall 25 towards the cone 10, as explained above. The configuration of the guide 18 is somewhat different in FIG. 6 from FIGS. 3-5, in that the radially outer end of the guide is not tangential to the periphery of the mill, but the essential function of the guide, preventing comminuted material from remaining against the peripheral wall of the mill as the pulp lifter rotates from the 6 o'clock position towards the 3 o'clock position, is the same.

FIGS. 7 and 8 illustrate another pulp lifter. The pulp lifter shown in FIGS. 7 and 8 is similar to that shown in FIG. 6 except that the intermediate wall 23 is not coextensive with the back wall 24 but extends only over the second section 16 of the pulp lifter. Thus, the space between the back wall and the intermediate wall that is not available to slurry in the lifter shown in FIG. 6 because of the guide 18 is part of the first section in the lifter shown in FIGS. 7 and 8.

Consequently, the area available for transfer of slurry from the first section 15 to the second section 16 via the transfer opening 17 is greater in the case of FIGS. 7 and 8 than in the case of FIG. 6. In addition, it will be appreciated that when multiple pulp lifters as shown in FIG. 6 are installed, the trailing edge wall 28 of the leading pulp lifter partially blocks the transfer openings 17 of the following pulp lifter, and only the portion forward of the dashed line 29 shown in FIG. 6 is available for flow of slurry. In the case of FIGS. 7 and 8, for a pulp lifter of similar size the transfer openings 17 of the following pulp lifter are of greater effective area because they are not partially blocked by the leading pulp lifter.

The use of the guide 18 in the pulp lifters shown in the drawings is advantageous for several reasons. First, the transfer of slurry from the first section 15 to the second section 16 through the transfer opening prevents flowback through the grate from the second section as the pulp lifter rises from the 6 o'clock position to the 3 o'clock position. Second, by preventing accumulation of material in the outer trailing area of the pulp lifter, the guide 18 ensures that there is minimal carryover of pebbles and slurry as the mill rotates.

The pulp lifter assembly described in U.S. Pat. No. 7,566,017 includes a pulp lifter structure that comprises an outer pulp lifter, an inner pulp lifter, and a discharger. Referring to FIGS. 9-13 of the drawings, in which the pulp lifter structure is oriented so that it rotates in the clockwise direction when viewed along the axis of rotation of the mill from the feed trunnion, the outer pulp lifter has a leading wall 102, a radially outer wall 104, a radially inner wall 106, an axially downstream wall 108, and an intermediate wall 110 that is generally parallel to and spaced from the axially downstream wall 108 and is connected to the axially downstream wall by a curved guide 112. The walls 102-110 and the guide 112 define an inlet chamber 115 that is open towards the viewer and to the right of the figure. The leading wall 102 is formed with a transfer opening 117 (FIG. 9A) that provides access to an outlet chamber 116 defined between the intermediate wall 110 and the axially downstream wall 108 and bounded by the guide 112. The radially inner wall is formed with an outlet opening 119. Multiple outer pulp lifters as shown in FIGS. 9 and 9A are attached to the axially downstream wall of the mill in an annular array. The inlet chamber 115 of a leading pulp lifter communicates with the outlet chamber 116 of a following pulp lifter via the transfer opening 117 in the wall 102 of the following pulp lifter.

Referring to FIG. 10, inner pulp lifters 120 are attached to the axially downstream wall of the body of the mill in an annular array inward of the outer pulp lifters 100. There is one inner pulp lifter 120 for each two adjacent outer pulp lifters 100. Each inner pulp lifter 120 comprises an axially downstream wall 122 and two radial walls 124, the radial walls 124 being aligned respectively with the leading walls 102 of two adjacent outer pulp lifters 100. Each two adjacent radial walls 124 of an inner pulp lifter define a channel 126 into which the outlet opening of an outer pulp lifter debouches. Similarly, the following radial wall 124 of a leading inner pulp lifter and the leading radial wall of a following inner pulp lifter define a channel into which the outlet opening 119 of an outer pulp lifter debouches.

The pulp lifter structure further comprises dischargers 130 (FIGS. 11 and 12) that are attached to the axially downstream wall of the mill in an annular array inward of the inner pulp lifters 120. Each discharger has an axially downstream wall 132 and two radial walls 134 and 136 projecting from the wall 132. Each discharger defines a discharge channel between its two radial walls 134, 136, and each two adjacent dischargers define a discharge channel between the following wall 136 of the leading discharger and the leading wall 134 of the following discharger. It will be noted from FIG. 11 that the leading wall 134 is radially shorter than the following wall 136. The channel defined between the two walls 134, 136 of the discharger, and the channel defined between the wall 134 of the leading discharger and the wall 136 of the following discharger, open into a discharge space defined between the wall 136 of the leading discharger and the wall 136 of the following discharger. The axially downstream wall 132 of the following discharger is formed with an opening 138 that communicates with the discharge space defined between the following wall 136 of the following discharger and the wall 136 of the leading discharger.

Referring to FIG. 12, a center liner 140 is attached to the inner pulp lifter 120 and a grate plate 150 is attached to the outer pulp lifter 100. The grate plates 150 collectively form the grate of the grinding mill.

In operation, as the mill rotates and an outer pulp lifter approaches the 6 o'clock position, slurry (which may include pebbles) enters the inlet chamber through the openings 152 in the grate plate. As the outer pulp lifter moves towards the 9 o'clock position, the outer pulp lifter rises relative to the following pulp lifter and slurry in the inlet chamber 115 of the leading pulp lifter flows through the transfer opening 117 in the leading wall of the following outer pulp lifter and enters the outlet chamber 116 of that pulp lifter. As the mill continues to rotate, the slurry in the outlet chamber of the outer pulp lifter flows along the guide 112 and flows through the opening 119 in the radially inner wall 106 into the channel 126 of the inner pulp lifter, and ultimately into the discharger 130. Most of the slurry leaves the discharger through the opening 138 and moves towards the guide cone (not shown).

The speed with which particles in the pulp lifter move towards the dischargers 130 influences the efficiency of the pulp lifter structure, in that higher velocity particles are likely to reach the discharge space by the time that the discharger attains the 12 o'clock position, whereas lower velocity particles are more likely to be impeded by friction against the trailing wall that bounds the discharge channel of the inner pulp lifter or discharger 130, so that the particles do not reach the discharge space by the time the discharger attains the 12 o'clock position, and are more likely to be carried over and remain in the pulp lifter structure during the next revolution of the mill.

The velocity that is attained by particles moving towards the discharger 130 depends on the curvature of the guide 112 and the angular extent of the guide about the axis of rotation of the pulp lifter structure. For larger values of the curvature of the guide, a particle moves with greater velocity radially inward along the guide as the pulp lifter rises. Similarly, for larger values of the angular extent of the guide about the axis of rotation of the pulp lifter, the particle is subject to the influence of the guide over a greater proportion of the revolution of the pulp lifter. However, ease of fabrication of the components of the pulp lifter structure, and ease of assembly, are facilitated if the pulp lifter has a smaller angular extent about the axis of rotation. The pulp lifter structure described with reference to FIGS. 9-12 is designed such that there are 32 individual pulp lifters distributed about the axis of rotation of the mill. Consequently the guide 112 of each pulp lifter has an angular extent of 11.25°. It would be desirable to increase the angular extent of the guide if this could be achieved without adversely affecting the manufacturability of the pulp lifter structure.

SUMMARY OF THE INVENTION

In accordance with a first aspect of the disclosed subject matter there is provided a pulp lifter assembly for a rotary grinding mill, the pulp lifter assembly comprising an outer pulp lifter including walls defining a pulp lifter chamber and an outlet opening for radially inward discharge of slurry from the pulp lifter chamber, an inner discharger disposed radially inward of the outer pulp lifter and circumferentially offset from the outer pulp lifter, the inner discharger defining a passage for conveying slurry substantially radially inward, and a transition discharger disposed radially between the outer pulp lifter and the inner discharger, wherein the transition discharger comprises a first wall bounding an interior space, and a second wall dividing the interior space into first and second regions, wherein the second wall includes a guide that bounds a channel connecting the outlet opening of the outer pulp lifter to the passage defined by the inner discharger.

In accordance with a second aspect of the disclosed subject matter there is provided a pulp lifter assembly for a rotary grinding mill, the pulp lifter assembly comprising: at least first and second outer pulp lifters each including walls defining walls defining an outer pulp lifter chamber and defining an outlet opening for radially inward discharge of slurry from the pulp lifter chamber, an inner discharger disposed radially inward of the outer pulp lifters and circumferentially offset from the first outer pulp lifter, the inner discharger defining a passage for conveying slurry substantially radially inward, and a transition discharger disposed radially between the outer pulp lifters and the inner discharger, wherein the transition discharger comprises: a first wall bounding an interior space, and a second wall dividing the interior space into first and second regions, wherein the second wall includes a first guide that bounds a first channel connecting the outlet opening of the first outer pulp lifter to the passage defined by the inner discharger and also bounds a channel connecting the outlet opening of the second outer pulp lifter to a second passage bounded by the inner discharger.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 2:
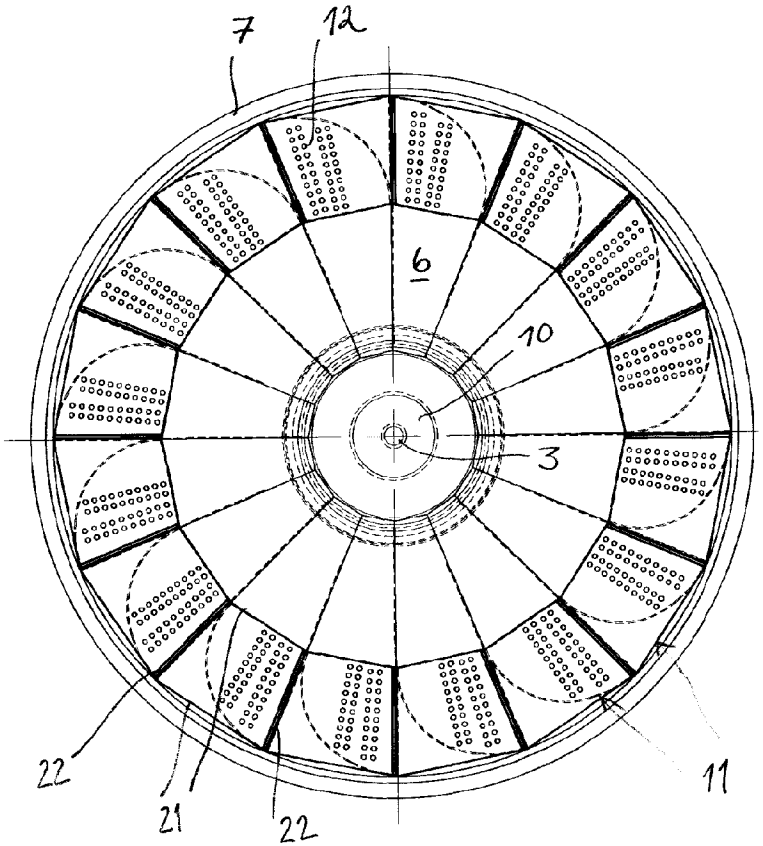
Fig. 2 PRIOR ART
FIG. 2 is a sectional view of the grinding mill taken on the line A-A of FIG. 1.
Figure 1:
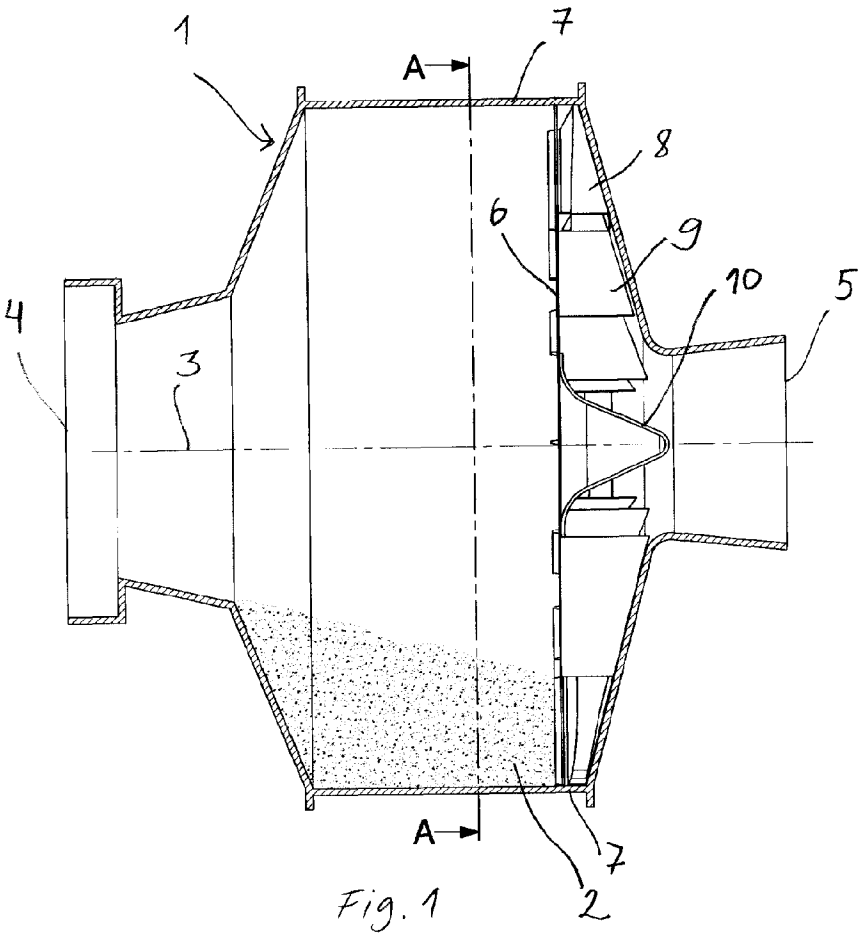
Fig. 1 PRIOR ART
FIG. 1 shows a sectional side view of a rotary grinding mill in accordance with the prior art.
Figure 5:
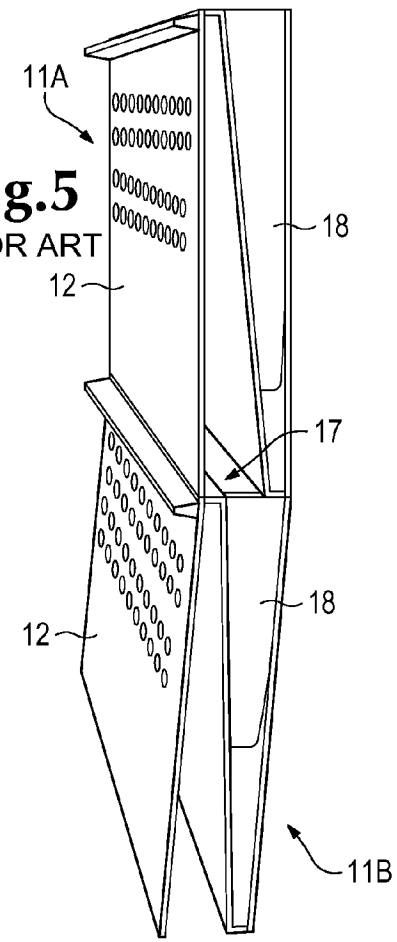
Fig.5 PRIOR ART
FIG. 5 shows the structure of FIG. 3 as a schematic side view.
Figure 4:
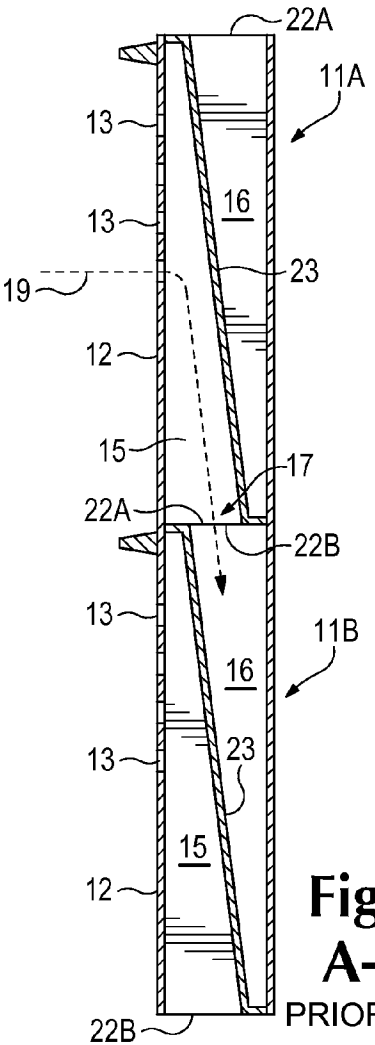
FIG. 4 shows the structure of FIG. 3 in section taken on the line B-B.
Figure 3:
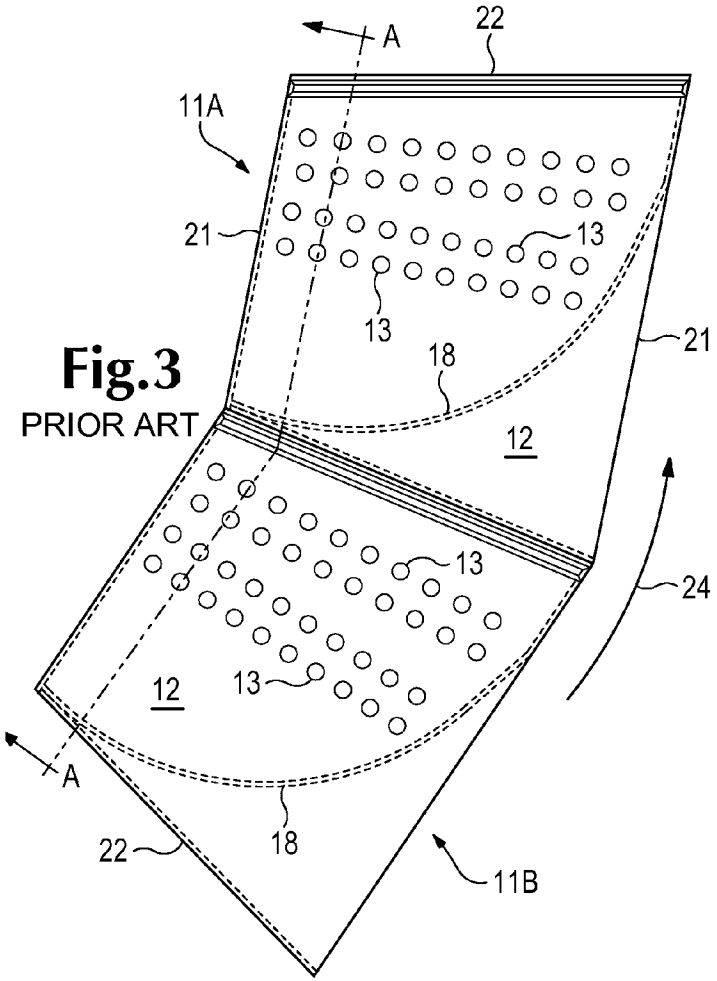
Fig.3 PRIOR ART
FIG. 3 shows a schematic front view of two pulp lifter units of the grinding mill shown in FIG. 1.
Figure 6:
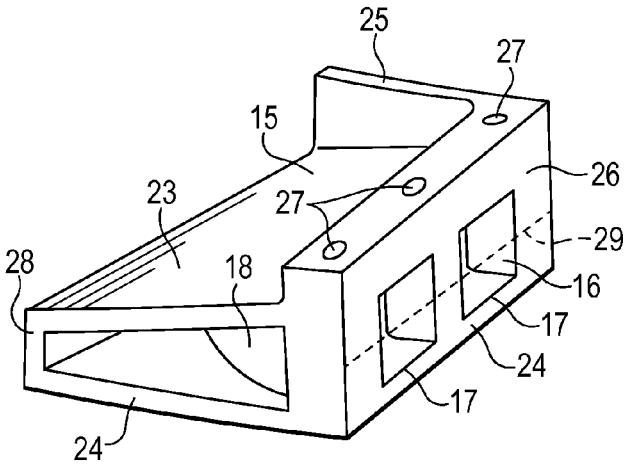
Fig.6 PRIOR ART
FIG. 6 is a perspective view of a second pulp lifter in accordance with the prior art.
Figure 7:
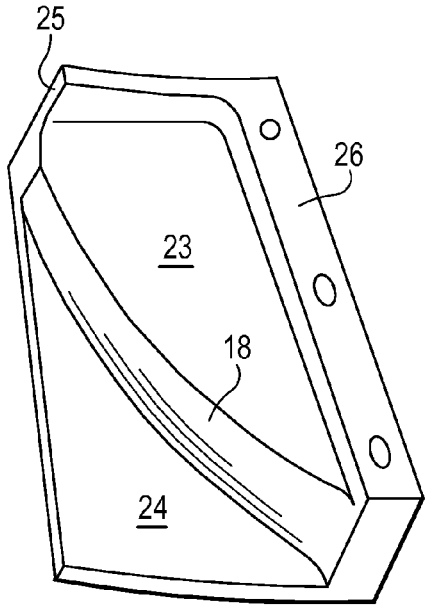
Fig.7 PRIOR ART
FIG. 7 is a perspective view of a third pulp lifter in accordance with the prior art.
Figure 8:
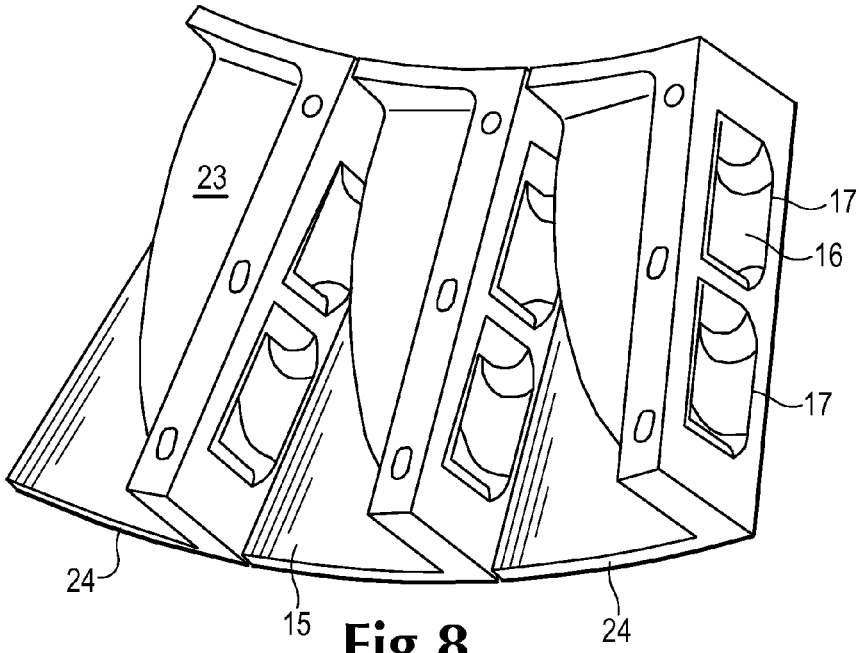
Fig.8 PRIOR ART
FIG. 8 is a perspective view illustrating the manner in which the pulp lifter shown in FIG. 7 cooperates with other pulp lifters of similar structure.
Figure 9A:
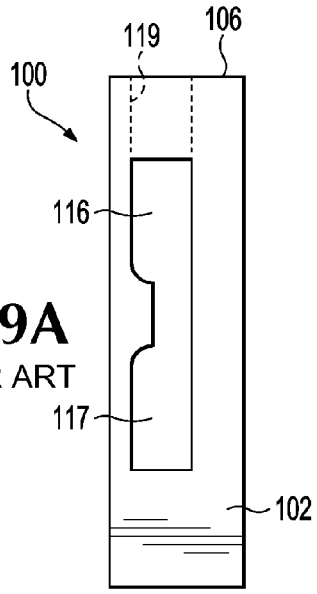
Fig.9A PRIOR ART
FIG. 9A is a view of the component shown in FIG. 8 taken on the line 9A-9A of FIG. 9, FIGS. 10-12 are perspective views of the fourth pulp lifter structure at different stages of assembly.
Figure 9:
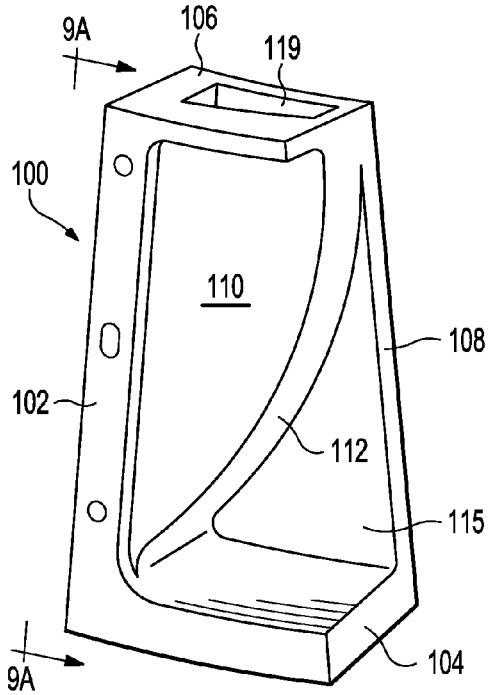
Fig.9 PRIOR ART
FIG. 9 is a perspective view of a component of a fourth pulp lifter structure in accordance with the prior art.
Figure 10:
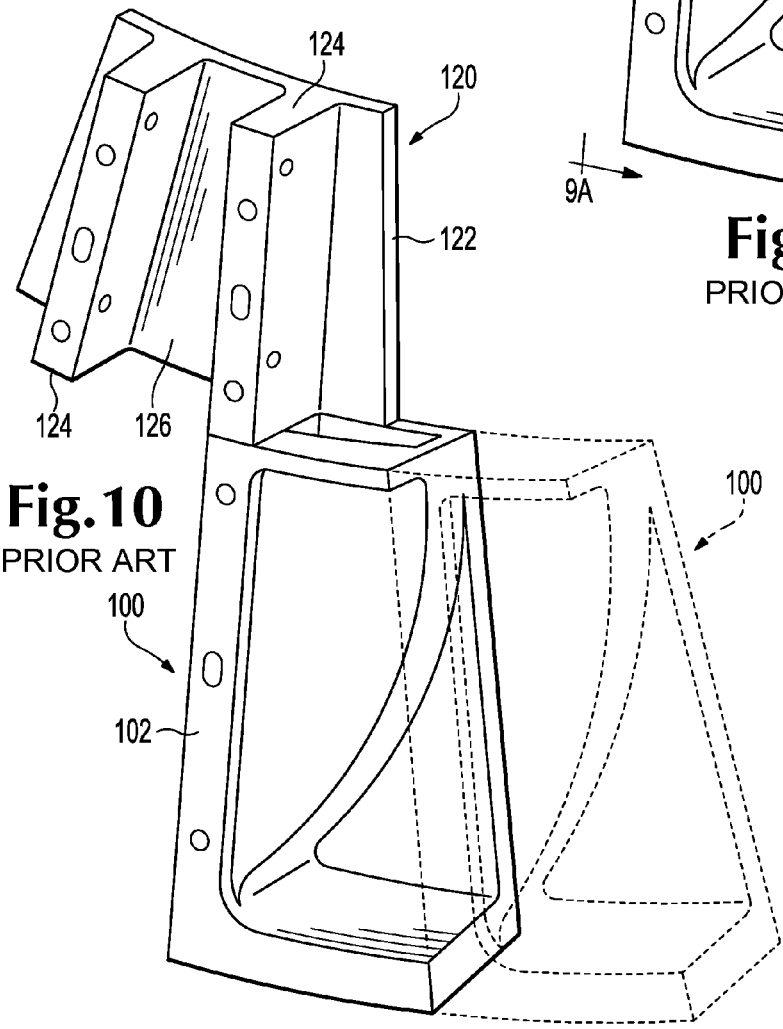
Fig.10 PRIOR ART
Figure 11:
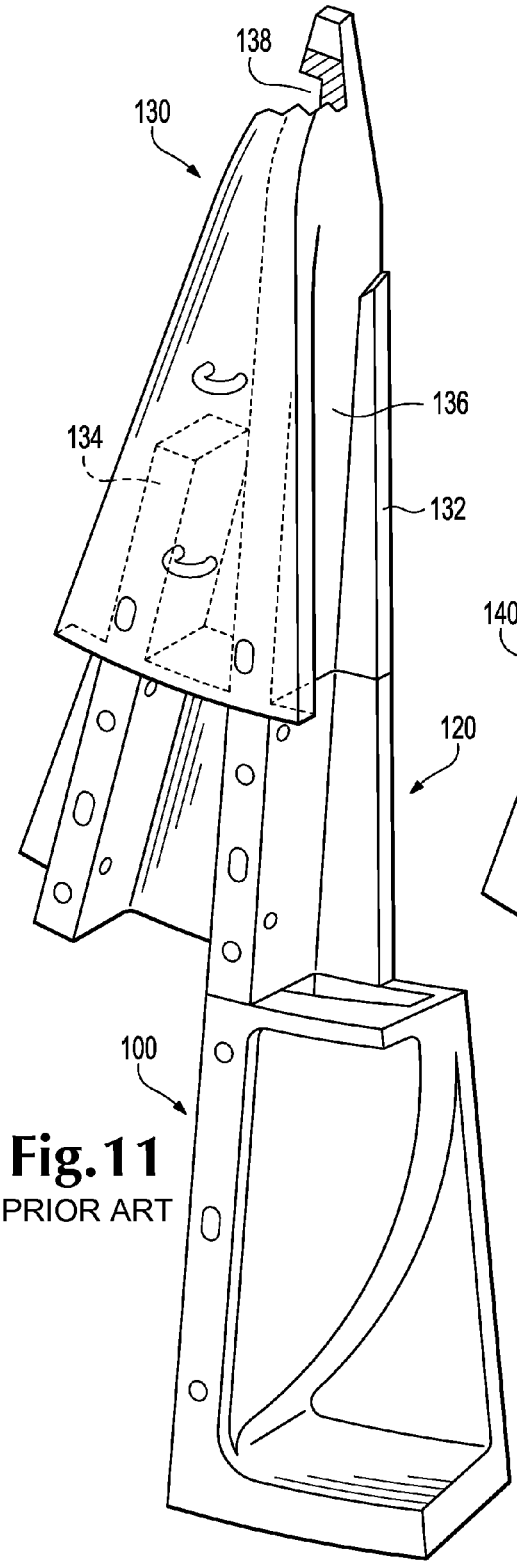
Fig.11 PRIOR ART
Figure 12:
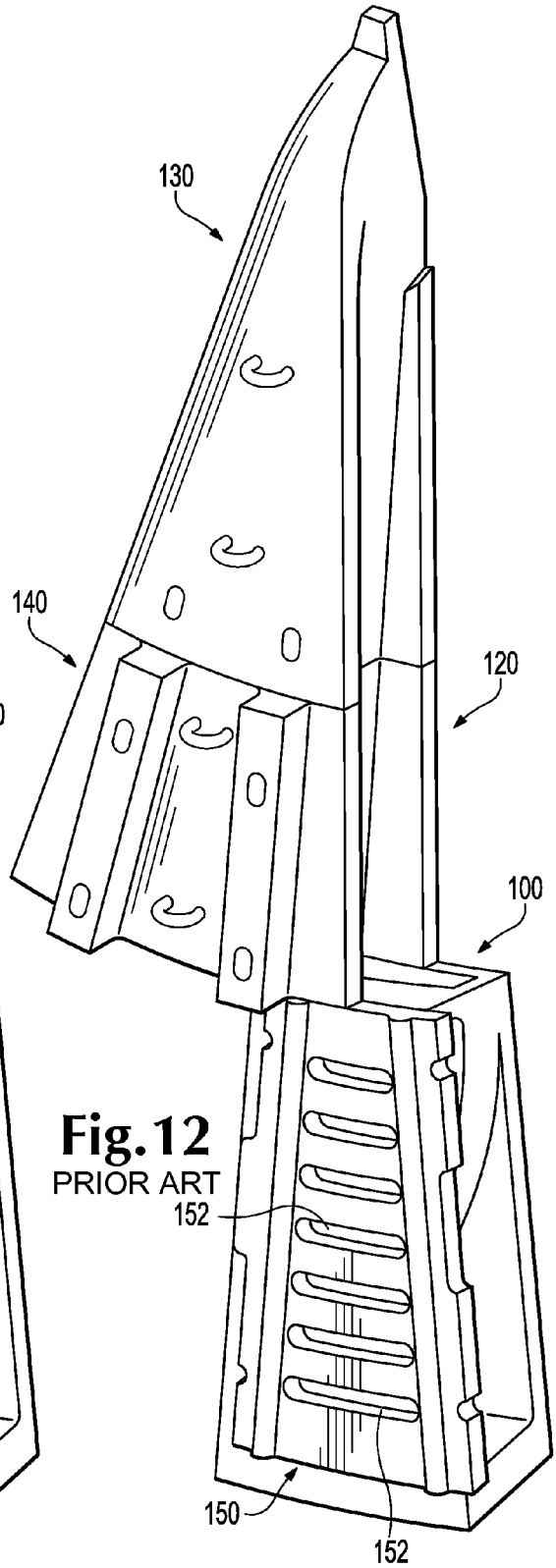
Fig.12 PRIOR ART

FIGS. 13-16 illustrate a pulp lifter assembly that comprises an annular array of outer pulp lifters 200, similar to the pulp lifters 100 shown in FIGS. 11 and 12, and a circular arrangement of inner dischargers 230, similar to the dischargers 130 shown in FIGS. 11 and 12. Each inner discharger 230 defines a discharge channel between its two radial walls 234, 236, and each leading discharger and the adjacent following discharger define a discharge channel between the wall 236 of the leading discharger and the wall 234 of the following discharger. As in the case of FIG. 11, the wall 234 of the following discharger is radially shorter than the wall 236 of the leading discharger. The channel defined between the two walls 234, 236 of a following discharger 230, and the channel defined between the wall 234 of the following discharger and the wall 236 of the adjacent leading discharger, open into a discharge space defined between the wall 236 of the leading discharger and the wall 236 of the following discharger. The axially downstream wall (or back wall) 232 of the following discharger is formed with an opening (not shown in FIGS. 13-16 but similar to the opening 138 shown in FIG. 11) that communicates with the discharge space defined between the wall 236 of the following discharger and the wall 236 of the leading discharger. The two radial walls 234, 236 of each inner discharger 230 thus define a first discharge channel, and the wall 234 of a following discharger and the wall 236 of the adjacent leading discharger define a second discharge channel, which meets the discharge channel defined by the two radial walls of the following discharger at the inner end of the radial wall 234.

Figure 16:
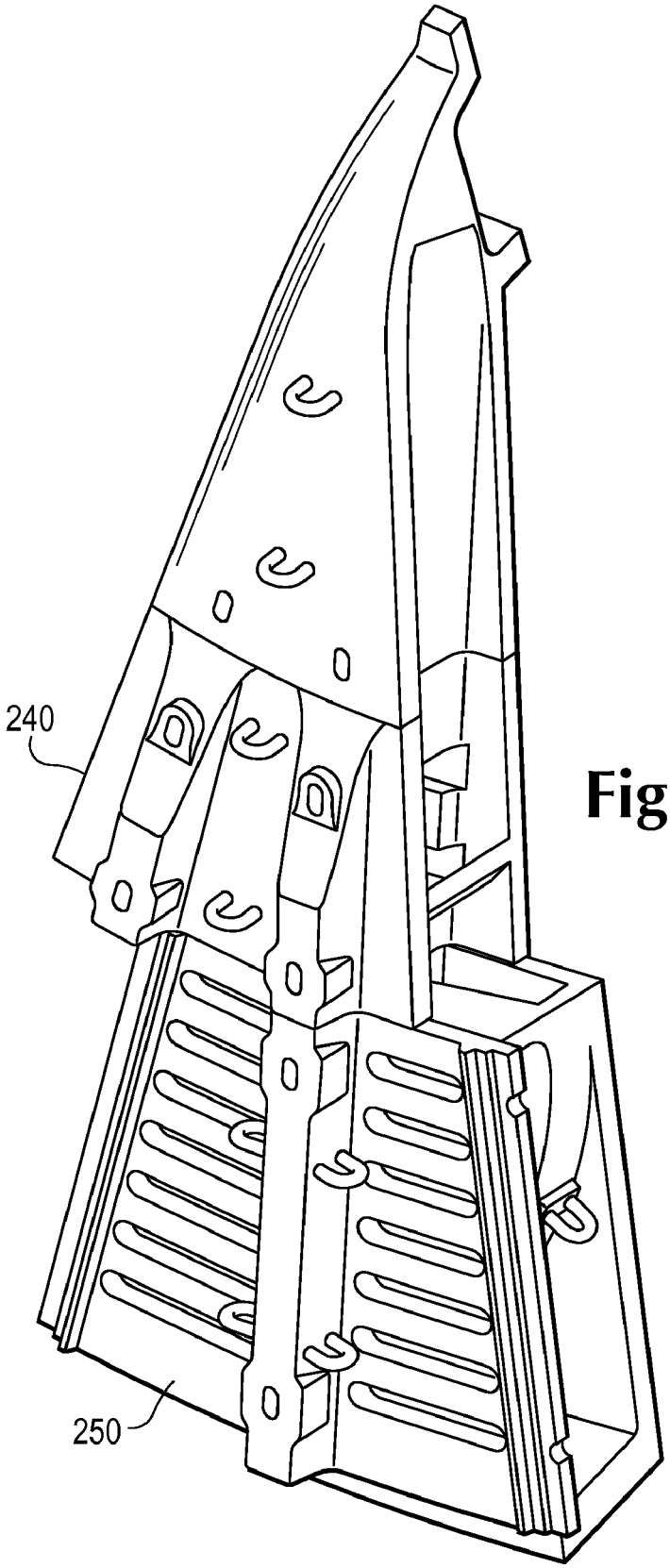

Referring to FIG. 16, a grate plate 250 is attached to the outer pulp lifter 200. The grate plates 250 collectively form the grate of the grinding mill.

Between the annular array of outer pulp lifters 200 and the circular arrangement of inner dischargers 230 is an annular array of transition dischargers 220. For each inner discharger 230 there is a corresponding transition discharger 220, and each transition discharger 220 is positioned between the two radii that bound the corresponding inner discharger 230.

Figure 13:
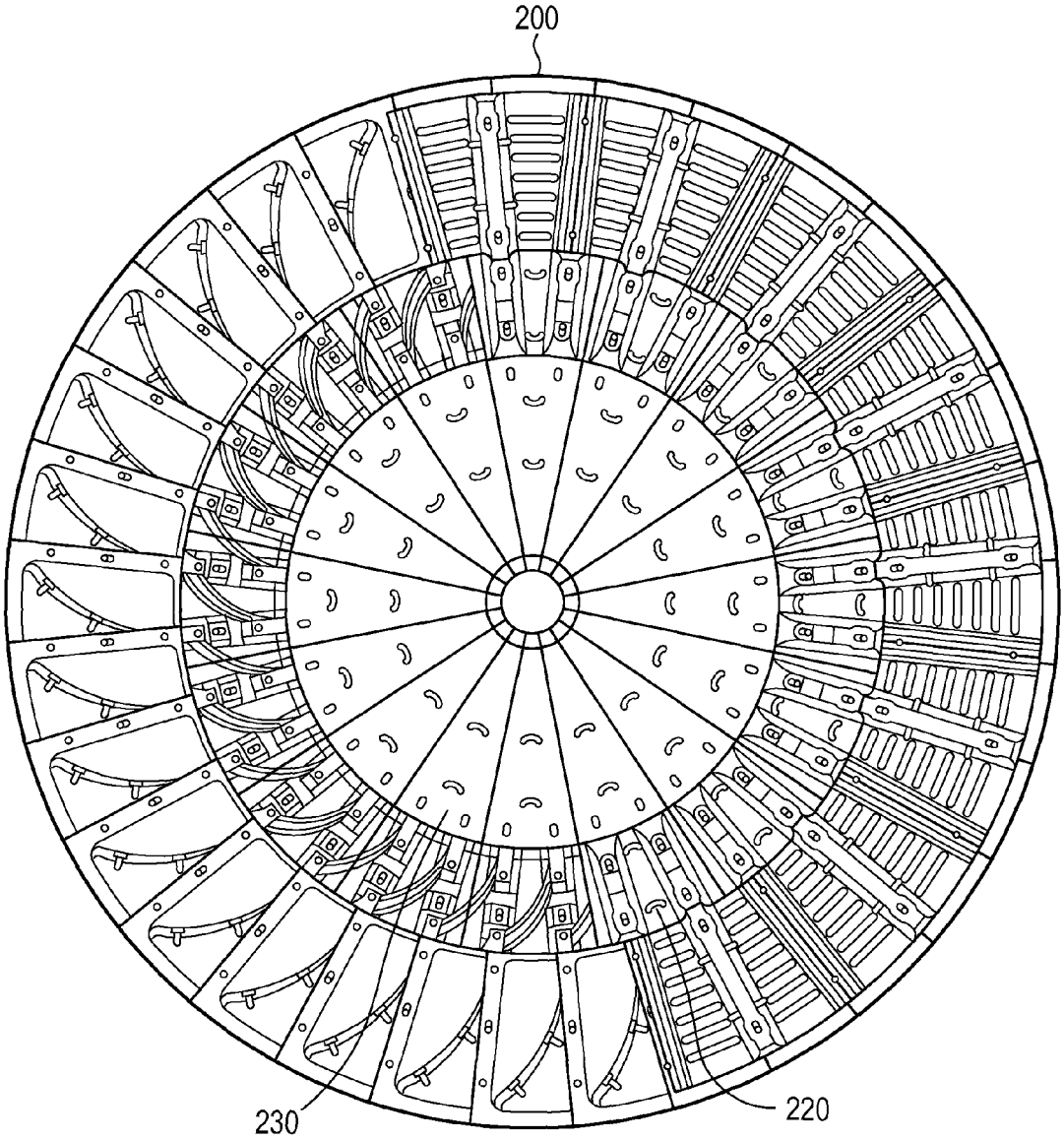
FIG. 13 is a view similar to FIG. 2 of a pulp lifter assembly embodying the subject matter disclosed in this application.

As shown in FIG. 13, the pulp lifter assembly comprises sixteen inner dischargers and sixteen transition dischargers, and each transition discharger is associated with three angularly adjacent pulp lifters. One of the three pulp lifters (referred to as a center pulp lifter) is associated exclusively with the transition discharger whereas each of the other two pulp lifters (referred to as leading and trailing pulp lifters) is associated with two angularly adjacent transition dischargers.

Figure 14:
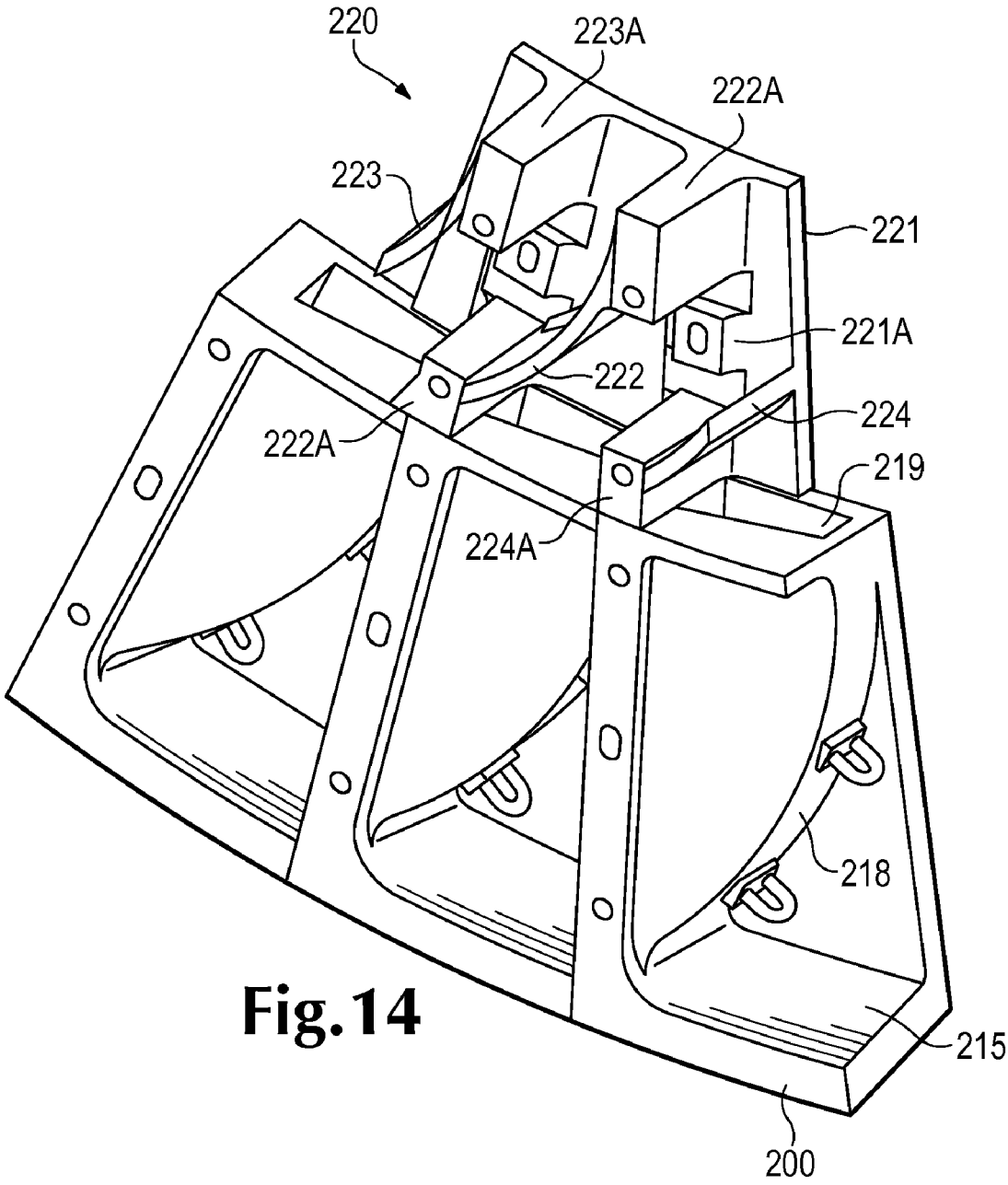
FIGS. 14-16 are enlarged perspective views of the pulp lifter assembly shown in FIG. 13 at different stages of assembly.
Figure 15:
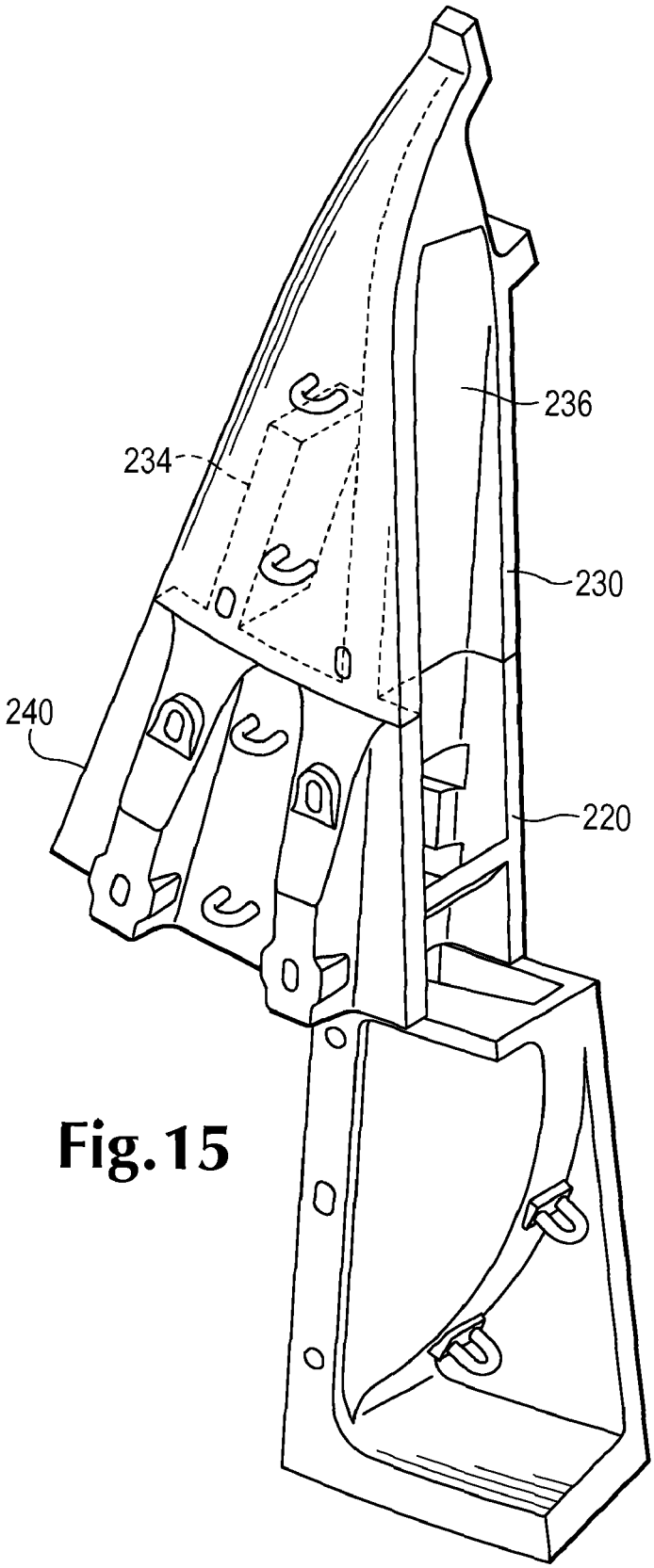

Referring to FIG. 14, each transition discharger 220 includes a back wall 221 lying substantially parallel and coplanar with the back wall 232 of the inner discharger module and three walls 222-224 projecting substantially perpendicularly to the back wall 221. The back wall 221 includes attachment structures 221A for receiving fasteners for attaching the transition discharger to the frame of the body of the mill. The back wall has two radial edges and inner and outer peripheral edges.

The projecting wall 222 extends the entire distance from the outer peripheral edge of the back wall to the inner peripheral edge of the back wall and includes attachment structures 222A at each end for receiving fasteners that attach a liner 240 (FIG. 16) to the back wall of the transition discharger. The projecting wall 222 is curved, its leading side being concave and its trailing side being convex. The radially outer end of the leading side of the wall 222 is adjacent the leading side of the outlet opening 219 in the leading pulp lifter, whereas the leading side of the inner end of the wall is substantially flush with the leading side of the wall 236 of the inner discharger 230.

The projecting wall 222 may be considered to be composed of inner and outer segments that meet at a radius that is midway between the radial edges of the back wall 221. The projecting wall 223, including the attachment structure 223A, corresponds in configuration to the inner segment of the wall 222 and extends from the leading radial edge of the back wall to the inner peripheral edge of the back wall. The projecting wall 224, including the attachment structure 224A, corresponds in configuration to the outer segment of the wall 222 and extends from the outer peripheral edge of the back wall to the trailing radial edge of the back wall. Thus, as shown in the drawings, the projecting walls 223 and 224 of a following transition discharger and a leading transition discharger respectively together have substantially the configuration of the projecting wall 222 of a transition discharger. The walls 222 and 223 of a center transition discharger and the wall 224 of the leading transition discharger form a first channel and the walls 222 and 224 of the center transition discharger and the wall 223 of a following transition discharger form a second channel. The two channels extend from the outer peripheral edge of the annular array of transition dischargers to the inner peripheral edge of the annular array of transition dischargers and the trailing walls defining the respective channels are curved such that the inner end of the trailing wall trails the outer end of that wall.

The liner 240 of the transition discharger covers the channels defined between the wall 222 and the walls 223 and 224. The liner is formed with holes for receiving fasteners that attach the liner to the attachment structures 222A, 223A and 224A and with attachment eyes for facilitating handling of the transition discharger.

In operation of the pulp lifter assembly, each pulp lifter 200 in turn rotates through the 6 o'clock position, in which slurry enters the pulp lifter through holes 252 in the grate plate 250. As the pulp lifter rotates towards the 9 o'clock position, the pulp lifter rises relative to the following pulp lifter and slurry in the first section 215 of the leading pulp lifter flows through the transfer openings (not shown in FIGS. 13-16) into the second section 216 of the following pulp lifter, as described with reference to FIGS. 9-12. As the pulp lifters continue to rotate, the slurry in the second section 216 of the following pulp lifter flows along the leading side of the guide 218 and flows through the opening 219 in the inner edge wall towards the annular array of transition dischargers. Depending on the angular position of the pulp lifter relative to the transition dischargers, the slurry either enters the channel between leading side of the wall 222 of a following transition discharger and the trailing side of the wall 224 of a leading transition discharger, or enters the channel between the trailing side of the wall 222 and the leading side of the wall 224 of the same transition discharger, and flows down the leading side of the wall 222 or 224, as the case may be. The rotation of the pulp lifter assembly provides a force that tends to fling the slurry back into the outer pulp lifter, but the slope of the wall 222 (or 223 and 224), particularly as the pulp lifter rotates beyond the 10 o'clock position, provides a centripetal force that resists outward movement of the slurry, and the slurry falls under the force of gravity into the inner discharger and passes towards the discharge cone.

It will be appreciated from inspection of FIGS. 13-16 that a particle that enters a channel of the transition discharger, for example at the 10 o'clock position, will be accelerated more strongly than would be the case in the event that the projecting walls were radial, as shown in FIGS. 9-12. Accordingly, the particle attains a higher velocity before it reaches the 12 o'clock position, and there is a greater likelihood that the particle will be discharged from the pulp lifter instead of being carried over for a second revolution of the mill.

The pulp lifter assembly described with reference to FIGS. 13-16 includes only one annular array of transition dischargers 220. In a modification of the pulp lifter assembly shown in FIGS. 13-16, there may be two (or more) arrays of transition dischargers between the annular array of outer pulp lifters and the circular arrangement of inner dischargers. Thus, FIG. 17 illustrates a pulp lifter assembly including an array of outer transition dischargers 320 and an array of inner transition dischargers 340 between the pulp lifters 300 (which are essentially the same as the pulp lifters 200) and the inner dischargers 330.

Figure 17:
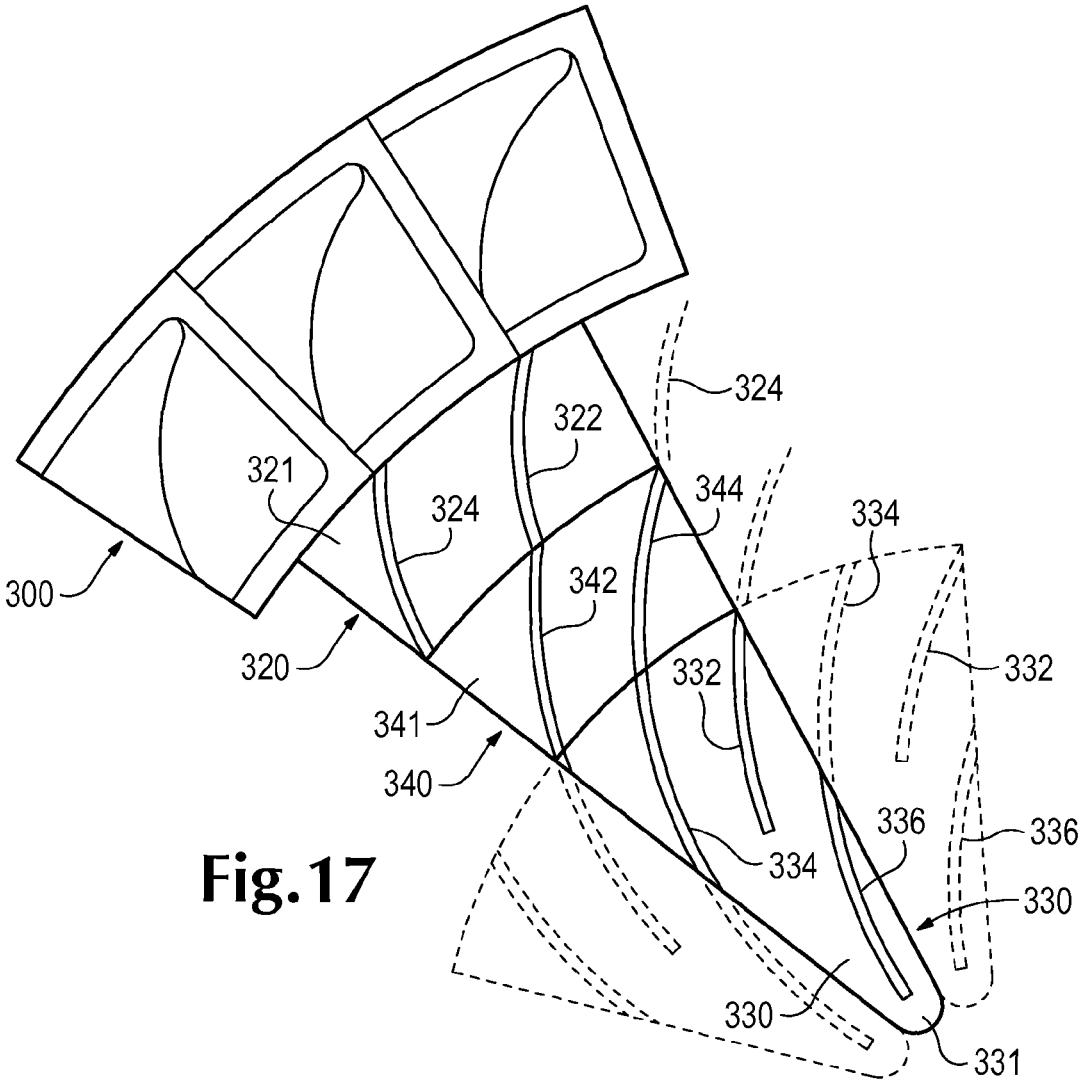
FIG. 17 is an enlarged partial view of a further pulp lifter assembly embodying the subject matter disclosed in this application.

As shown in FIG. 17, each outer transition discharger 320 is associated with three angularly adjacent pulp lifters 300. The center pulp lifter is associated exclusively with the outer transition discharger whereas each of the other two pulp lifters is associated with two angularly adjacent outer transition dischargers. The outer transition discharger 320 includes a back wall 321 and two walls 322, 324 projecting substantially perpendicularly to the back wall. The back wall 321 includes attachment structures (not shown) for receiving fasteners for attaching the outer transition discharger to the frame of the body of the mill. The back wall has two radial edges and inner and outer peripheral edges.

The projecting walls 322, 324 each extend the entire distance from the outer peripheral edge of the back wall 321 to the inner peripheral edge of the back wall and include attachment structures (not shown) for receiving fasteners that attach a liner (not shown, but similar in function to the liner 240 shown in FIG. 16) to the back wall of the transition discharger. Each of the projecting walls 322, 324 is curved, its leading side being concave and its trailing side being convex. The radially outer end of the leading side of the wall 322 is adjacent the trailing side of the outlet opening of the leading pulp lifter whereas the radially outer end of the leading side of the wall 324 is adjacent the trailing side of the outlet opening of the center pulp lifter. The two projecting walls 322, 324 of an outer transition discharger define a first transition channel whereas the wall 322 of a given outer transition discharger and the wall 324 of an adjacent leading outer transition discharger define a second transition channel.

The inner transition discharger 340 shown in solid lines in FIG. 17 is associated with two adjacent outer transition dischargers 320. One of the associated outer transition dischargers is illustrated in solid lines and is referred to as the aligned outer transition discharger. The other associated outer transition discharger is shown only partially, in dashed lines, and is referred to as the leading outer transition discharger. The inner transition discharger 340 includes a back wall 341 and two walls 342, 344 projecting substantially perpendicularly to the back wall. The back wall 341 includes attachment structures (not shown) for receiving fasteners for attaching the inner transition discharger to the frame of the body of the mill. The back wall has two radial edges and inner and outer peripheral edges.

The projecting walls 342, 344 each extend the entire distance from the outer peripheral edge of the back wall 341 to the inner peripheral edge of the back wall and include attachment structures (not shown) for receiving fasteners that attach a liner (not shown, but similar in function to the liner 240 shown in FIG. 16) to the back wall of the transition discharger. Each of the projecting walls 342, 344 is curved, its leading side being concave and its trailing side being convex. The radially outer end of the wall 342 is adjacent the radially inner end of the wall 322 of the aligned outer transition discharger whereas the radially outer end of the wall 344 is adjacent the radially inner end of the wall 324 of the leading outer transition discharger. The two projecting walls 342, 344 of an inner transition discharger define a first transition channel, as an extension of the second transition channel defined by the wall 322 of the aligned outer transition discharger and the wall 324 of the leading outer transition discharger, whereas the wall 344 of a given inner transition discharger and the wall 342 of the adjacent leading inner transition discharger define a second transition channel, as an extension of the first transition channel defined by the walls 322, 324 of the leading outer transition discharger.

The inner discharger 330 is associated with an aligned inner transition discharger 340 and a leading inner transition discharger and includes a back wall 331 and three walls 332, 334, 336 projecting substantially perpendicularly to the back wall. The back wall 331 includes attachment structures (not shown) for receiving fasteners for attaching the outer transition discharger to the frame of the body of the mill. The back wall has two radial edges aligned respectively with the radial edges of the back wall of the aligned inner transition discharger.

The projecting wall 334 extends from a location about half way along the outer peripheral edge of the back wall 331 to a location about half way along the trailing radial edge of the back wall 331. At its radially outer end, the wall 334 is aligned with the radially inner end of the wall 344 of the aligned inner transition discharger. The projecting wall 332 is of similar configuration to the wall 334, but extends from a location in the region of the leading end of the outer peripheral edge of the back wall to a location about half way between the outer peripheral edge of the back wall and the radially inner edge of the wall 331 and about half way between the radial edges of the back wall. The projecting wall 336 extends from a location about half way along the leading radial edge of the back wall to a location near the radially inner region of the back wall. At its radially outer end, the wall 336 is aligned with the radially inner end of the wall 334 of the leading inner discharger. Each of the projecting walls is curved, its leading side being concave and its trailing side being convex.

The two projecting walls 334, 332 of an inner discharger define a first discharger channel, as an extension of the second transition channel defined by the wall 344 of the aligned inner transition discharger and the wall 342 of the leading inner transition discharger, whereas the wall 332 of a given inner discharger and the wall 334 of the adjacent leading inner discharger define a second discharger channel, as an extension of the first transition channel defined by the walls 342, 344 of the leading inner transition discharger. It will be noted that the discharger channels cross the radial boundary between adjacent inner dischargers 330.

It will be appreciated that because the projecting walls of the transition dischargers and the inner dischargers are configured so that the inner end of each wall trails the outer end of the wall, and in particular is curved so that the leading side of the wall forming the following boundary of a channel is inclined to the radius at a greater angle at radially outward positions than at radially inward positions, a particle that enters a channel of an outer transition discharger, for example at the 10 o'clock position, will continue to be accelerated by gravity as the mill rotates even when the particle enters the discharger 330. Accordingly, the particle attains a higher velocity before it reaches the 12 o'clock position than it would in the case of the pulp lifter shown in FIGS. 9-12, and there is a greater likelihood that the particle will be discharged from the pulp lifter instead of being carried over for a second revolution of the mill.

It will be appreciated that the disclosed subject matter is not restricted to the particular embodiment(s) that has (have) been described, and that variations may be made therein without departing from the scope of the subject matter as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A pulp lifter assembly for a rotary grinding mill, the pulp lifter assembly comprising:

an outer pulp lifter including walls defining a pulp lifter chamber and an outlet opening for radially inward discharge of slurry from the pulp lifter chamber, an inner discharger disposed radially inward of the outer pulp lifter and circumferentially offset from the outer pulp lifter, the inner discharger defining a passage for conveying slurry substantially radially inward, and a transition discharger disposed radially between the outer pulp lifter and the inner discharger, wherein the transition discharger comprises:

a first wall bounding an interior space, and a second wall dividing the interior space into first and second regions, wherein the second wall includes a guide that bounds a channel connecting the outlet opening of the outer pulp lifter to the passage defined by the inner discharger.

2. A pulp lifter structure according to claim 1, wherein the guide has a concave side that bounds said channel and the transition discharger further comprises a third wall that projects from the first wall and is spaced from the second wall and has a surface that is convex towards the concave side of the second wall and bounds said channel.

3. A pulp lifter assembly for a rotary grinding mill, the pulp lifter assembly comprising:

at least first and second outer pulp lifters each including walls defining walls defining an outer pulp lifter chamber and defining an outlet opening for radially inward discharge of slurry from the pulp lifter chamber, an inner discharger disposed radially inward of the outer pulp lifters and circumferentially offset from the first outer pulp lifter, the inner discharger defining a passage for conveying slurry substantially radially inward, and a transition discharger disposed radially between the outer pulp lifters and the inner discharger, wherein the transition discharger comprises:

a first wall bounding an interior space, and a second wall dividing the interior space into first and second regions, wherein the second wall includes a first guide that bounds a first channel connecting the outlet opening of the first outer pulp lifter to the passage defined by the inner discharger and also bounds a channel connecting the outlet opening of the second outer pulp lifter to a second passage bounded by the inner discharger.

4. A pulp lifter assembly according to claim 3, comprising a second inner discharger disposed angularly adjacent the first inner discharger, and wherein the second passage is bounded partially by the first inner discharger and partially by the second inner discharger.

* * * * *